US008886074B2

(12) United States Patent
Hamaya

(10) Patent No.: US 8,886,074 B2
(45) Date of Patent: Nov. 11, 2014

(54) IMAGE FORMING APPARATUS

(71) Applicant: Masahito Hamaya, Nagoya (JP)

(72) Inventor: Masahito Hamaya, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 14/026,044

(22) Filed: Sep. 13, 2013

(65) Prior Publication Data

US 2014/0079429 A1 Mar. 20, 2014

(30) Foreign Application Priority Data

Sep. 19, 2012 (JP) ..... 2012-205917

(51) Int. Cl.
*G03G 15/00* (2006.01)

(52) U.S. Cl.
CPC ..... *G03G 15/80* (2013.01); *G03G 2215/0141* (2013.01)
USPC ..... 399/89

(58) Field of Classification Search
CPC ..... G03G 15/5004; G03G 15/80
USPC ..... 399/50, 88, 89
See application file for complete search history.

(56) References Cited

U.S. PATENT DOCUMENTS

| | | | | |
|---|---|---|---|---|
| 5,495,316 | A * | 2/1996 | Muto | 399/46 |
| 6,173,129 | B1 * | 1/2001 | Kimizuka | 399/25 |
| 7,024,125 | B2 * | 4/2006 | Ishii et al. | 399/50 |
| 7,139,501 | B2 * | 11/2006 | Takami et al. | 399/89 |
| 7,899,352 | B2 * | 3/2011 | Tomiie et al. | 399/89 |
| 8,543,018 | B2 * | 9/2013 | Maekawa | 399/43 |
| 2009/0317118 | A1 | 12/2009 | Sakai et al. | |
| 2010/0054790 | A1 * | 3/2010 | Inukai | 399/88 |
| 2012/0134707 | A1 * | 5/2012 | Inukai | 399/88 |
| 2014/0079429 | A1 * | 3/2014 | Hamaya | 399/88 |

FOREIGN PATENT DOCUMENTS

| | | | |
|---|---|---|---|
| JP | 6-250500 | A | 9/1994 |
| JP | 2002-238259 | A | 8/2002 |
| JP | 2008-58629 | A | 3/2008 |
| JP | 2010-002527 | A | 1/2010 |

* cited by examiner

*Primary Examiner* — W B Perkey
(74) *Attorney, Agent, or Firm* — Scully, Scott, Murphy & Presser, P.C.

(57) ABSTRACT

An image forming apparatus includes a power supply circuit, at least one motor configured to receive electric power from the power supply circuit, a photosensitive body configured to be rotated by the motor for forming an image on a sheet, a charger configured to charge the photosensitive body, a high voltage generation circuit configured to receive electric power from the power supply circuit and generate a high voltage applied to the charger, and a control device. The control device is configured to determine whether a motor activation condition to activate the motor is satisfied, determine whether a limitation condition to limit a peak of a current output from the power supply circuit is satisfied, and regulate the current flowing through the high-voltage generation circuit if the motor activation condition and the limitation condition are satisfied.

15 Claims, 10 Drawing Sheets

IMAGE FORMING APPARATUS

CROSS REFERENCE TO RELATED APPLICATION

This application claims priority from Japanese Patent Application No. 2012-205917 filed on Sep. 19, 2012. The entire content of this priority application is incorporated herein by reference.

TECHNICAL FIELD

The disclosure relates to an image forming apparatus.

BACKGROUND

It is well known that a current value detection circuit for overcurrent protection is provided at a primary side of a switching power supply circuit.

SUMMARY

An image forming apparatus disclosed herein includes a power supply circuit, at least one motor configured to receive electric power from the power supply circuit, a photosensitive body configured to be rotated by the motor for forming an image on a sheet, a charger configured to charge the photosensitive body, a high-voltage generation circuit configured to receive electric power from the power supply circuit and generate a high voltage applied to the charger, and a control device. The control device is configured to determine whether a motor activation condition to activate the motor is satisfied, determine whether a limitation condition to limit a peak of a current output from the power supply circuit is satisfied, and regulate the current flowing through the high-voltage generation circuit if the motor activation condition and the limitation condition are satisfied, whereby the peak of the current output from the power supply circuit is limited.

DETAILED DESCRIPTION

<First Illustrative Aspect>

Figure 1:
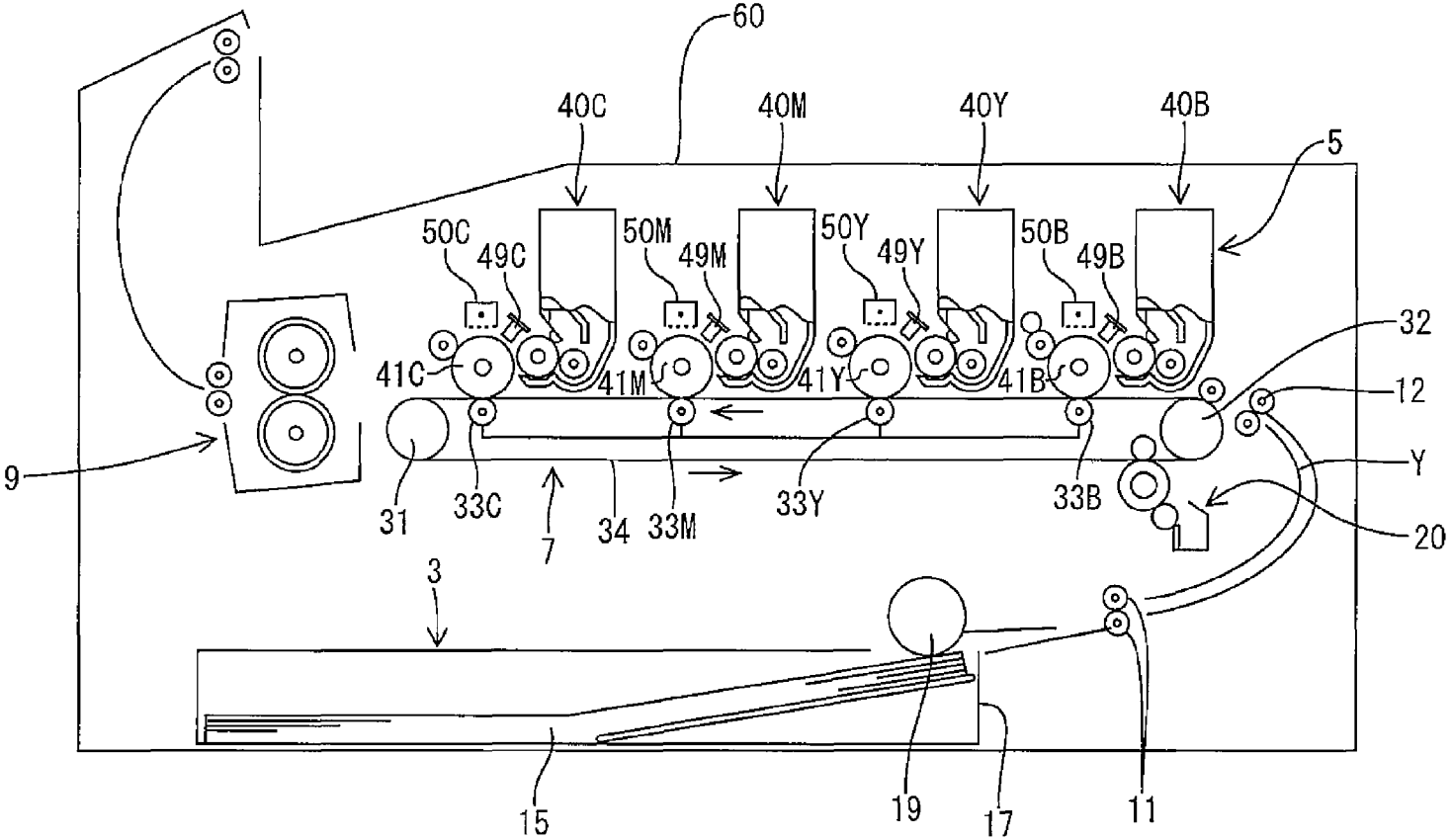
FIG. 1 is a schematic cross-sectional view illustrating an internal configuration of a printer according to an illustrative aspect.

A first illustrative aspect will be described with reference to FIGS. 1 to 7.

1. Overall Configuration of the Printer

In the following explanation, each alphabet B, Y, M, or C, which indicates black, yellow, magenta, or cyan, respectively, is added to a reference numeral if a member indicated by the reference numeral is distinguished by color. If the member is not distinguished by color, such an alphabet is not added.

As illustrated in FIG. 1, a printer 1 (an example of an image forming apparatus) includes a feeder 3, an image forming unit 5, a conveying mechanism 7, a fusing unit 9, a belt cleaning mechanism 20, a conveying roller 11, and a registration roller 12. The feeder 3 is located at a bottom of the printer 1. The feeder 3 includes a tray 17 for holding sheets (such as papers and OHP sheets) and a pickup roller 19. The sheets 15 in the tray 17 are each fed out by the pickup roller 19 and sent to the conveying mechanism 7 through the conveying roller 11 and the registration roller 12.

The conveying mechanism 7 is configured to convey the sheet 15 and located at an upper side of the feeder 3 in the printer 1. The conveying mechanism 7 includes a driving roller 31, a driven roller 32, and a belt 34. The belt 34 is arranged to bridge the driving roller 31 and the driven roller 32. Upon rotation of the driving roller 31, a part of the belt 34 that faces photosensitive drums 41B, 41Y, 41M, 41C is moved from a right side to a left side in FIG. 1. The photosensitive drums 41 are included in the image forming unit 5 and will be described later. In this configuration, the sheet 15 sent by the registration roller 12 is passed under the image forming unit 5.

The belt 34 is provided with four transfer rollers 33B, 33Y, 33M, 33C. The transfer rollers 33 are positioned to face the photosensitive drums 41B, 41Y, 41M, 41C with the belt 34 located therebetween.

The image forming unit 5 includes four process units 40B, 40Y, 40M, 40C and four exposure units 49B, 49Y, 49M, 49C each arranged to correspond to the respective process units 40B, 40Y, 40M, 40C. The process units 40B, 40Y, 40M, 40C are arranged in a line along a direction in which the sheet 15 is sent (a right-left direction in FIG. 1).

Figure 2:
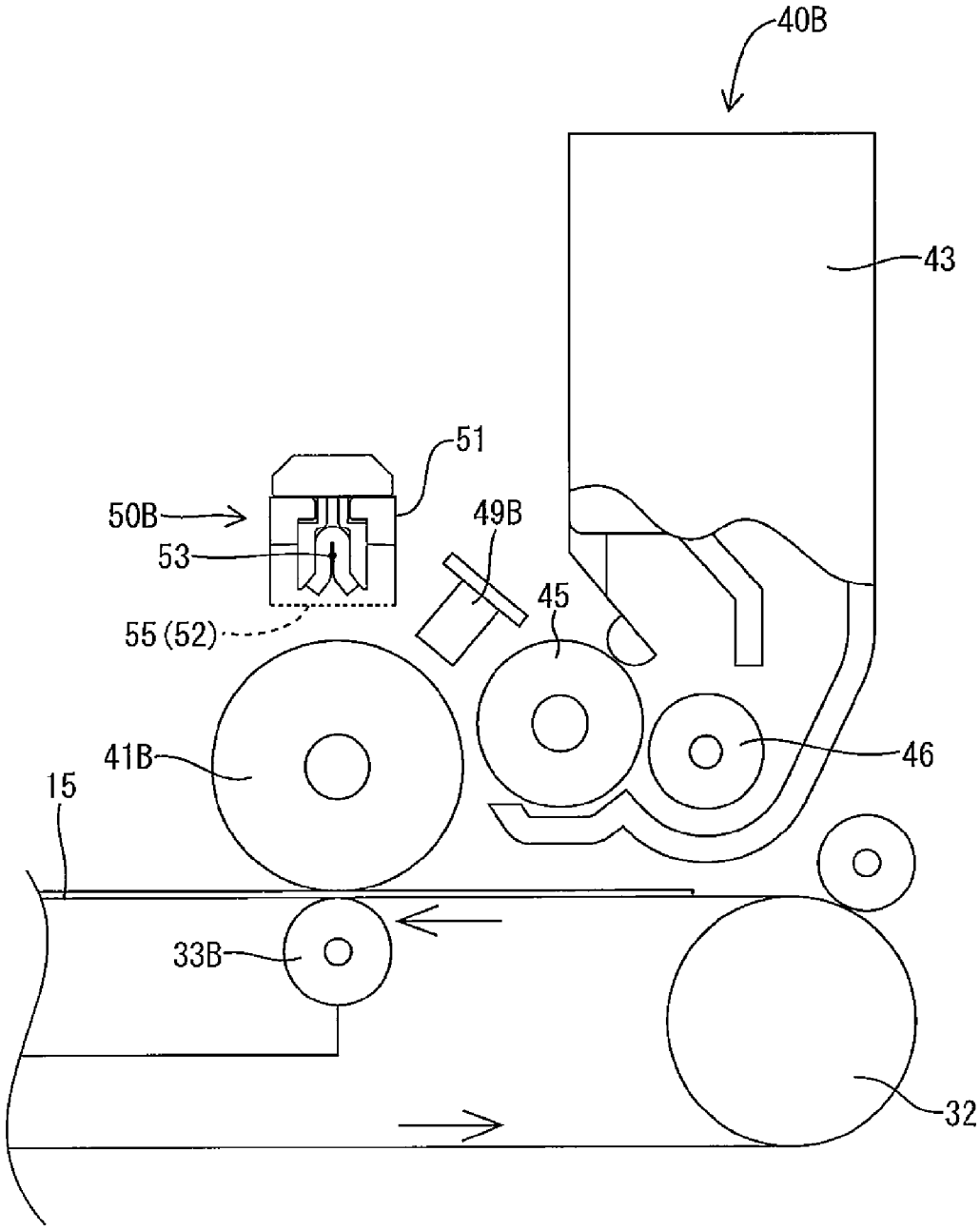
FIG. 2 is a schematic cross-sectional view illustrating a configuration of a process unit for black and components around the process unit.

The process units 40B, 40Y, 40M, 40C have the same configuration. The process unit 40B is illustrated in FIG. 2 as an example. The process unit 40B includes a photosensitive drum 41B (an example of a photosensitive body), a toner case 43 that houses toner as developer (for example, positively charged nonmagnetic one-component toner), a developing roller 45 (an example of a developing unit), a feed roller 46, and a charger 50B. Each process unit 40B, 40Y, 40M, 40C includes the photosensitive drum 41 and the charger 50 for corresponding color.

The photosensitive drum 41B, 41Y, 41M, 41C each include an aluminum substrate and a positively charged photosensitive layer arranged on the substrate, for example. The substrate is connected to a ground of the printer 1.

The developing roller 45 and the feed roller 46 that is configured to feed the toner from the toner case 43 are located at a lower side of the toner case 43 so as to face each other. When the toner passes between the developing roller 45 and the feed roller 46, the developing roller 45 positively charges the toner and supplies onto each photosensitive drum 41B, 41Y, 41M, 41C to form uniform thin toner layer thereon. Accordingly, the developing roller 45 develops an electrostatic latent image on the photosensitive drum 41.

The development roller 45 is movable between a contact position where the development roller 45 comes in close contact with the photosensitive drum 41 and a separated position where the development roller 45 is away from the photosensitive drum 41 by a displacement unit 70. An example of the displacement unit 70 is a separating and pressing mechanism disclosed in JP-A-2008-58629. The displacement unit 70 will be described in more detail later.

Each charger 50B, 50Y, 50M, 50C is a scorotron charger and, as illustrated in FIG. 2, includes a shield case 51, a wire 53, and a grid electrode 55 made of metal. The shield case 51 has a square tube shape elongated along a rotation axis of the photosensitive drum 41. The shield case 51 has a discharge opening 52 that opens toward the photosensitive drum 41.

The wire 53 is a tungsten wire, for example. The wire 53 is arranged in the shield case 51 so as to extend along a rotation axis direction of the photosensitive drum 41. A high voltage is applied to the wire 53 by a high-voltage generation circuit 150, which will be described later. The application of the high voltage to the wire 53 induces a corona discharge in the shield case 51. The corona discharge generates ions and the ions exit from the discharge opening 52 toward the photosensitive drum 41 resulting in a flow of discharging current from the charger 50 to the photosensitive drum 41. As a result, a surface of the photosensitive drum 41 is uniformly and positively charged. A discharge-starting voltage at which the discharge from the wire 53 starts is about 5 kV. In the image formation, a voltage of about 6.3 kV, which is higher than the discharge-starting voltage, is applied to the wire 53 to stabilize the discharge current at a level higher than a target level.

The grid electrode 55 having a plate like shape with slits or through holes is attached to the shield case 51 to cover the discharge opening 52. A voltage is applied to the grid electrode 55. The charge voltage of the photosensitive drum 41 can be controlled by the voltage applied to the grid electrode 55.

The exposure units 49B, 49Y, 49M, 49C are each include light emitting elements (such as LEDs) arranged in a line along the rotation axis of each photosensitive drum 41B, 41Y, 41M, 41C. The light emitting elements emit light according to print data that is sent by an external device, and thus an electrostatic latent image is developed on the surface of each photosensitive drum 41B, 41Y, 41M, 41C.

The image forming process executed by the printer 1 having the above-described configuration will be briefly explained. Upon receiving a print data, the printer 1 starts a printing process. At first, each charger 50B, 50Y, 50M, 50C uniformly and positively charges the surface of each photosensitive drum 41B, 41Y, 41M, 41C. Then, each exposure unit 49B, 49Y, 49M, 49C applies light onto each photosensitive drum 41B, 41Y, 41M, 41C. Accordingly, a predetermined electrostatic latent image for the image data is developed on the surface of each photosensitive drum 41B, 41Y, 41M, 41C. That is, the surface of each photosensitive drum 41B, 41Y, 41M, 41C that is uniformly and positively charged has a lower potential at a part to which the light is applied.

Then, the developing roller 45 is rotated to supply the positively charged toner that is held on the developing roller 45 to the electrostatic latent image formed on the surface of each photosensitive drum 41B, 41Y, 41M, 41C. This converts the electrostatic latent image on each photosensitive drum 41B, 41Y, 41M, 41C into a visible image, and thus a toner image developed through a reversal development is held on the surface of each photosensitive drum 41B, 41Y, 41M, 41C.

Concurrently with the above formation process of the toner image, a conveying process is executed to convey the sheet 15. Specifically, the pickup roller 19 is turned to send the sheets 15 to a sheet conveying path Y one by one. The sheets 15 sent to the sheet conveying path Y is conveyed to a transfer position by the conveying roller 11 and the belt 34. At the transfer position, a toner image on the photosensitive drum 41 is brought into contact with the transfer roller 33.

The toner image (a developer image) in each color on the surface of each photosensitive drum 41 is sequentially transferred onto the surface of the sheet 15 and superposed with each other by a transfer bias applied to each transfer roller 33. Thus, the toner image (the developer image) in color is formed on the sheet 15. Subsequently, the transferred toner image (the developer image) is thermally fused onto the sheet 15 when the sheet 15 is passed through the fusing unit 9 arranged at a rear side of the belt 34, which is a left side in FIG. 1. Then, the sheet 15 is ejected onto a discharge tray 60.

2. Electrical Configuration of the Printer 1

Figure 3:
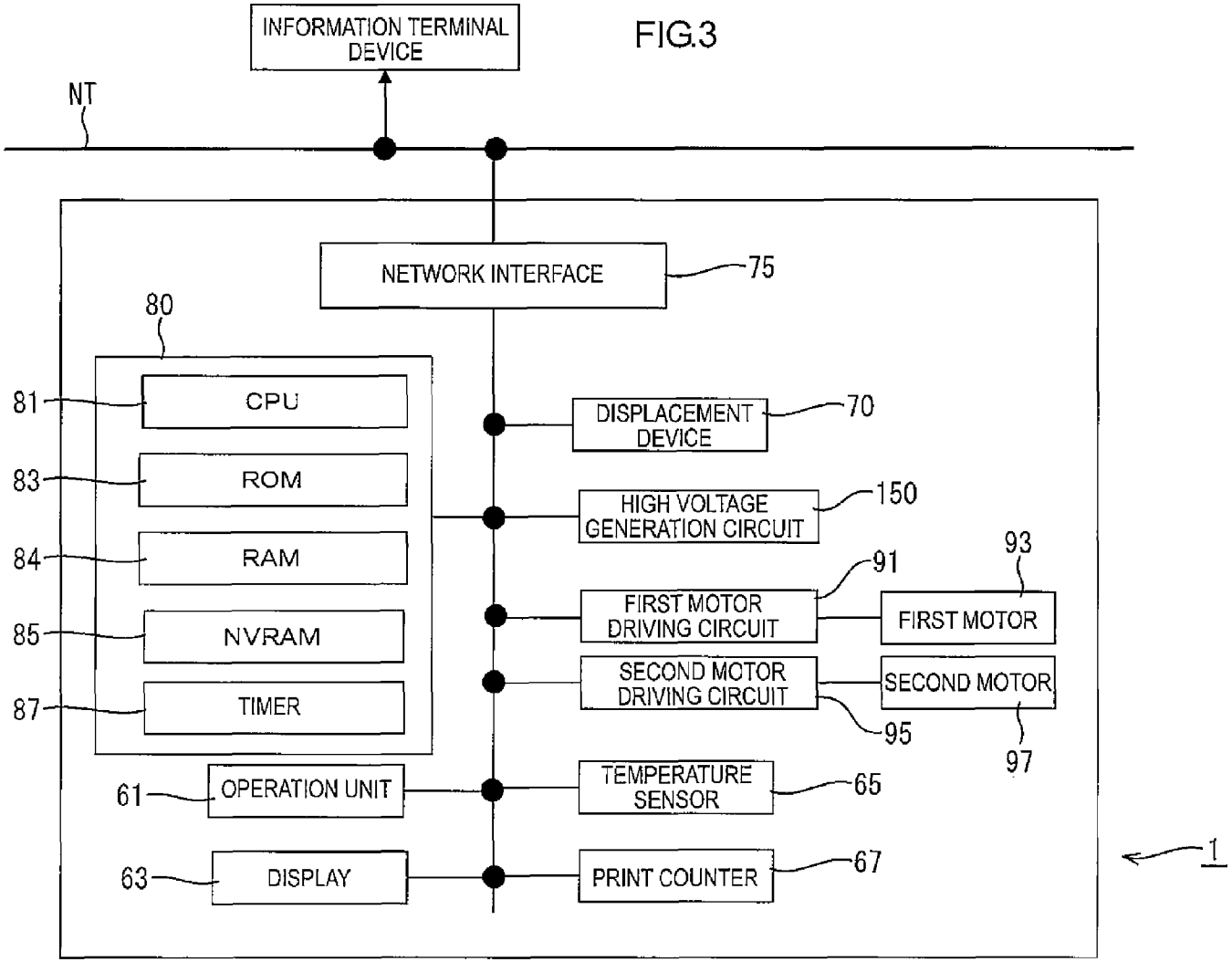
FIG. 3 is a block diagram illustrating an electrical configuration of the printer.

The electrical configuration of the printer 1 will be explained with reference to FIG. 3. The printer 1 includes the displacement unit 70, the high-voltage generation circuit 150, a first motor driving circuit 91, a second motor driving circuit 95, a first motor 93, a second motor 97, an operation unit 61, a display 63, a temperature sensor 65, a print counter 67, a network interface 75, and a control device 80. The control device 80 is an example of a control device. The temperature sensor 65 is an example of a sensor. The print counter 67 is an example of a counter.

The displacement unit 70 is configured to move the developing roller 45 between the contact position where the developing roller 45 comes in close contact with the photosensitive drum 41 and the separated position where the developing roller 45 is away from the photosensitive drum 41. The high-voltage generation circuit 150 is configured to receive power supplied by a low-voltage power supply circuit 100 and to generate a high voltage to be applied to each charger 50B, 50Y, 50M, 50C. The low-voltage power supply circuit 100 will be described later. The high-voltage generation circuit 150 is a self-excited flyback converter, for example. The control device 80 inputs a PWM signal S3 to the high-voltage generation circuit 150 (see FIG. 4). When the PWM signal S3 is input, the high-voltage generation circuit 150 activates and outputs a voltage (high voltage) corresponding to a PWM value of the PWM signal S3. Examples of the high-voltage generation circuit 150 include a "power supply 10" that is disclosed in JP-A-2011-75871 and a "voltage applying circuit 200" that is disclosed in JP-A-2012-32532.

The first motor 93 is a driving power source for the conveying mechanism 7 and the photosensitive drum 41B for black. The second motor 97 is a driving power source for each photosensitive drum 41Y, 41M, 41C for yellow, magenta, and cyan. The first motor driving circuit 91 is a circuit for controlling a motor current that is supplied to the first motor 93. The second motor driving circuit 95 is a circuit for controlling a motor current that is supplied to the second motor 97.

The operation unit 61 includes buttons. A user can input instructions to the printer 1 through the operation unit 61 for various printer operations such as printing images on a sheet 15. The display 63 includes a liquid crystal display and a lamp, for example. The display 63 is configured to display various setting screens and an operating status. The temperature sensor 65 is arranged in the printer 1 and is configured to measure a temperature inside the printer 1. The print counter 67 is configured to count the accumulated number of the printed sheets 15. The number in the counter is incremented by one as one sheet 15 is printed. The network interface 75 is connected to an information terminal device such as a PC or a FAX via a communication line NT that enables the communication therebetween.

The control device 80 is configured to control the components included in the printer 1. The control device 80 includes a CPU 81, a ROM 83, a RAM 84, a non-volatile NVRAM 85, and a timer 87 for measuring time. The ROM 83 stores various programs for controlling the printer 1. The RAM 84 and the NVRAM 85 are configured to store various data. When the control device 80 receives a print job from the information terminal device, the CPU 81 included in the control device 80 executes the printing process to print the image on the sheet 15 based on the print data of the print job.

3. A Power Supply Configuration of the Printer 1

Figure 4:
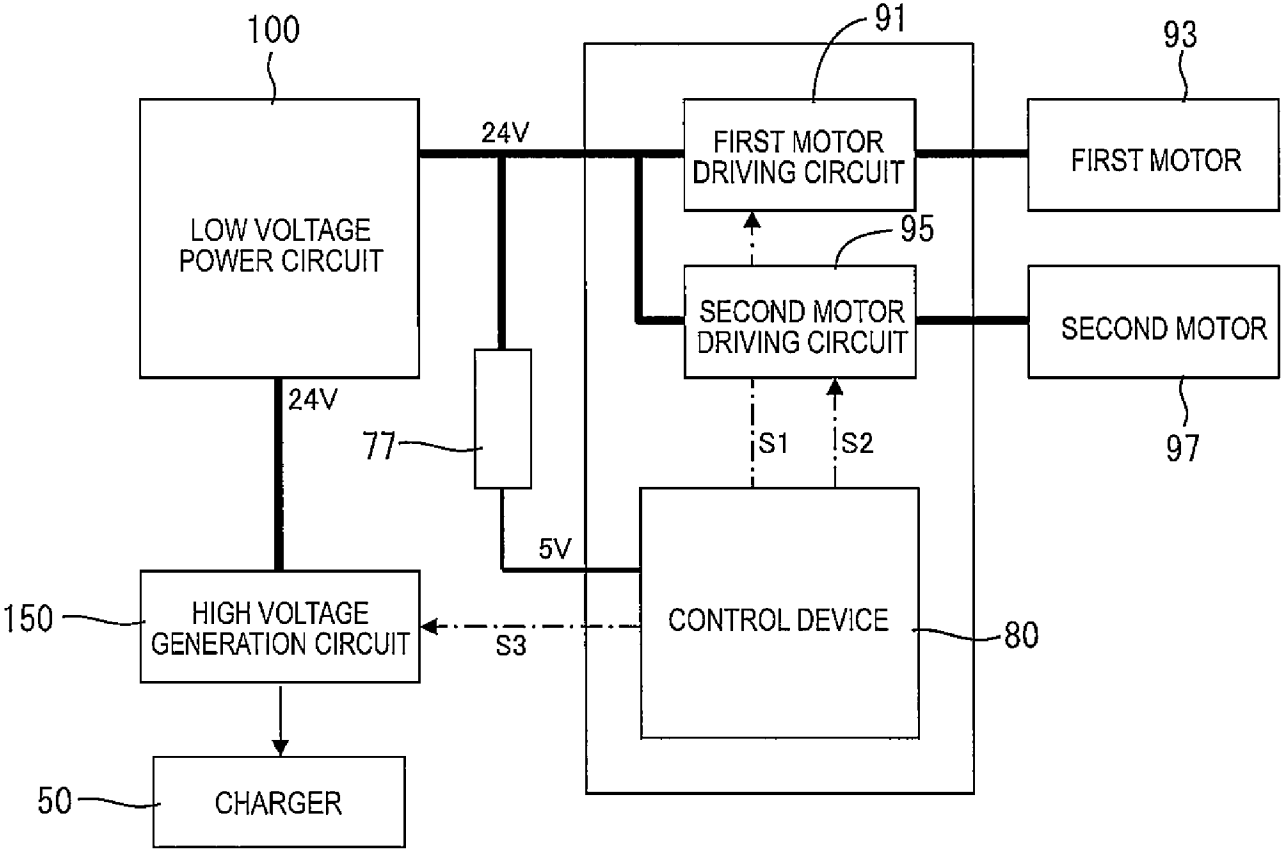
FIG. 4 is a block diagram illustrating a power supply configuration of the printer.

A power supply configuration of the printer 1 will be explained with reference to FIG. 4.

The printer 1 includes the low-voltage power supply circuit 100. The low-voltage power supply circuit 100 is configured to convert an AC voltage input from an AC power supply 130 into a DC voltage and output the DC voltage. The output voltage of the low-voltage power supply circuit 100 is DC 24 V. A power-supply voltage of 24V is applied to the high-voltage generation circuit 150 by the low-voltage power supply circuit 100. Further, the first motor driving circuit 91 and the second motor driving circuit 95 are connected to the low-voltage power supply circuit 100 such that the power-supply voltage of 24 V is applied to the first motor 93 and the second motor 97 by the low-voltage power supply circuit 100. A DC-DC converter 77 is connected between the low-voltage power supply circuit 100 and the control device 80. The DC-DC converter 77 is configured to reduce the voltage of 24 V output by the low-voltage power supply circuit 100 to 5 V such that the power-supply voltage of 5 V is applied to the control device 80.

The control device 80 is connected to the first and second motor driving circuits 91, 95 via signal lines. The control device 80 inputs control signals S1, S2 to the first motor driving circuit 91 and the second motor driving circuit 95, respectively, to control the first motor activation timing t1 and the second motor activation timing t2 (see FIG. 7). The first motor activation timing is timing to activate the first motor 93, i.e., to start feeding the motor current (starting current) to the first motor 93. The second motor activation timing t1, t2 is timing to activate the second motor 97, i.e., to start feeding the motor current (starting current) to the second motor 97.

In addition, the control device 80 is connected to the high-voltage generation circuit 150 via a signal line. The control device 80 inputs a control signal (PWM signal) S3 to the high-voltage generation circuit 150 to control the high-voltage generation circuit activation timing t3 (see FIG. 7) and the set voltage (set value of the output voltage) of the high-voltage generation circuit 150. The high-voltage generation circuit activation timing is a timing to activate the high-voltage generation circuit 150. In FIG. 4, the bold lines indicate the power supply lines and the one-dotted chain lines indicate the signal lines. The low-voltage power supply circuit 100 is an example of a power supply circuit.

4. Configuration of the Low-Voltage Power Supply Circuit 100

Figure 5:
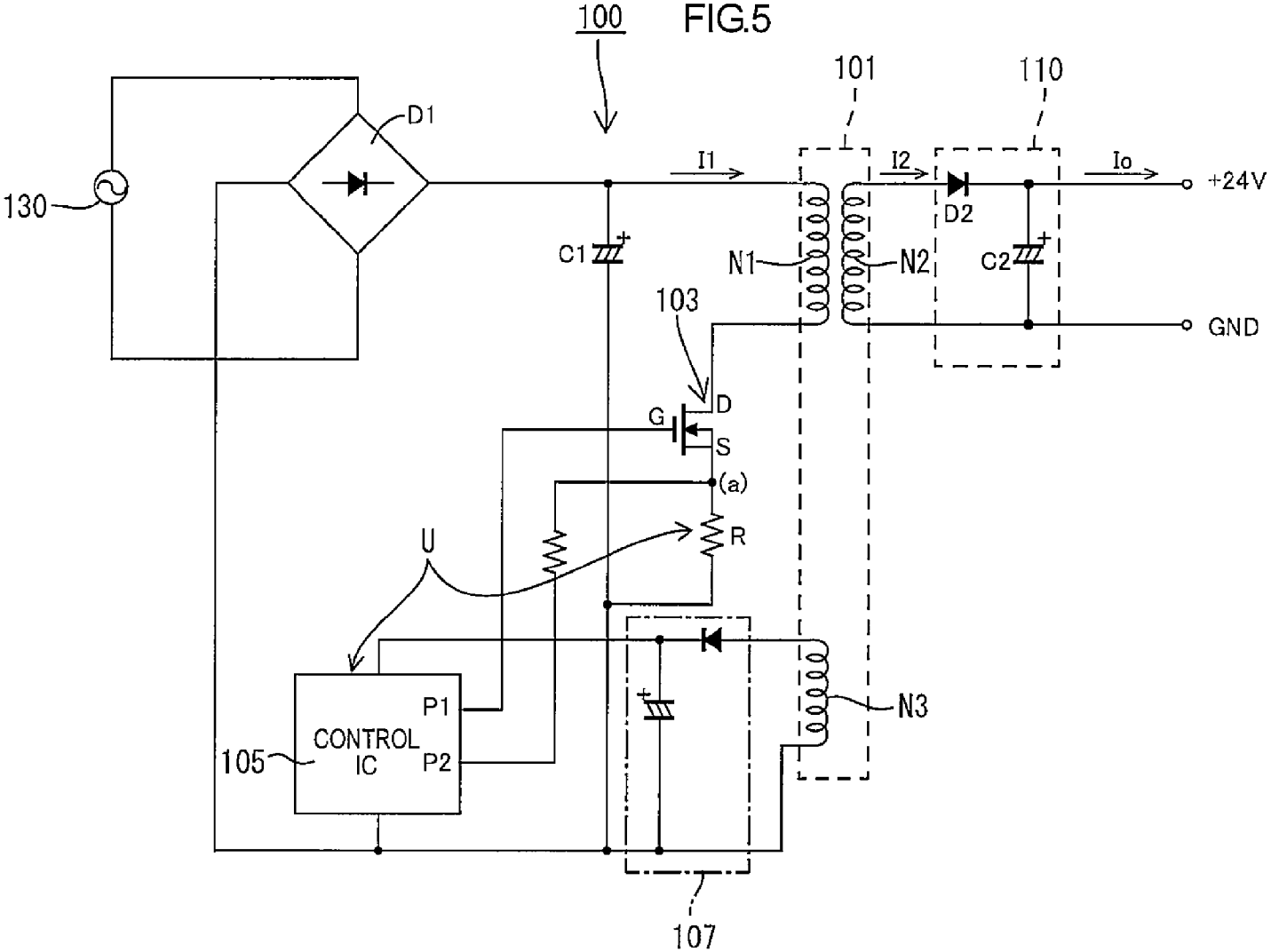
FIG. 5 is a circuit diagram of a low-voltage power supply circuit.

The configuration of the low-voltage power supply circuit 100 will be explained with reference to FIG. 5. The low-voltage power supply circuit 100 is a switching power supply circuit that includes an insulation transformer 101 having a primary coil N1, a secondary coil N2, and an auxiliary coil N3. The low-voltage power supply circuit 100 includes a bridge diode D1 for rectification, a capacitor C1 for smoothing, a FET (field-effect transistor) 103, a control IC 105 for switching control of the FET 103, a current detection resistor R, and a voltage generation circuit 107, at a primary side thereof The voltage generation circuit 170 is configured to generate a power-supply voltage for the control IC 105 by the voltage induced on the auxiliary coil N3 of the insulation transformer 101. The control IC 105 includes an output port P1 and an input port P2. Further, the low-voltage power supply circuit 100 includes a rectifying and smoothing circuit 110 at a secondary side thereof The rectifying and smoothing circuit 110 includes a diode D2 and a capacitor C2.

An AC voltage from the AC power 130 is rectified by the diode bridge D1 and then smoothed by the capacitor C1. Then, the voltage obtained by rectifying and smoothing the AC voltage from the AC power supply 130 is applied to the primary coil N1 of the insulation transformer 101.

The FET 103 is a N-channel MOSFET, and a drain D thereof is connected to the primary coil N1 of the insulation transformer 101 and a source S thereof is connected to the ground via the current detection resistor R. ON-OFF signals (PWM signal) are transmitted from the output port P1 of the control IC 105 to a gate G of the FET 103 to turn on and off the FET 103. Accordingly, the primary side of the insulation transformer 101 repeatedly turns on and off, and the voltage is induced in the secondary coil N2 of the insulation transformer 101.

The voltage induced in the secondary coil N2 of the insulation transformer 101 is rectified and smoothed by the rectifying and smoothing circuit 110, and then output. The output voltage of the low-voltage power supply circuit 100 is DC 24 V. The power-supply voltage of 24 V is applied to the electric components such as the high-voltage generation circuit 150 and the motors 93, 97 connected to the low-voltage power supply circuit 100.

The low-voltage power supply circuit 100 has an overcurrent protection implemented by an overcurrent protection circuit U so that the output current does not exceed a predetermined upper limit. Specifically, the current detection resistor R connected between the source S of the FET 103 and the ground is configured to detect a primary current I1 flowing in the primary side of the insulation transformer 103. The current detection resistor R is an example of a current detecting element.

A connection point (a) between the current detection resistor R and the source S of the FET 103 is connected to the input port P2 of the control IC 105. The control IC 105 is configured to detect a level of the voltage input to the input port P2, and thus the amount of the primary current I1 is detected.

The control IC 105 determines whether the detected primary current I1 is within a limit. If the primary current I1 exceeds the limit, the input of the ON-OFF signal to the FET 103 is stopped. The current detection resistor R and the control IC 105 at the primary side of the insulation transformer 101 configure the overcurrent protection circuit U. When the primary current I1 exceeds the limit, the low-voltage power supply circuit 100 is shut down to protect the low-voltage power supply circuit 100 from overcurrent.

5. Malfunction of the Overcurrent Protection Circuit U

As described above, in the printer 1, the current detection resistor R and the control IC 105, which configure the overcurrent protection circuit U, are located at the primary side of the low-voltage power supply circuit 100. Namely, a series of steps from the detection of the overcurrent to the shutdown of the circuit is completed at the primary side. With this configuration, the number of components can be reduced compared to a low-voltage power supply circuit that includes the current detection resistor R at the secondary side to detect the secondary current, and thus the substrate of the low-voltage power supply circuit 100 can be downsized. If the current detection resistor R is included at the secondary side, the number of components increases, because a photo coupler or some components may be required to send the result of the detection to the control IC 105 arranged at the primary side.

The primary current I1 and the secondary current I2 of the insulation transformer 101 are substantially in a proportional relationship. However, the secondary current I2 and an output current Io of the low-voltage power supply circuit 100 may vary with respect to the primary current I1 due to leakage flux or other factors. Due to the variation in current, in the overcurrent protection process to shut down the low-voltage power supply circuit 100 based on the detected primary current I1, the overcurrent protection circuit U may be activated based on the detected primary current I1 having a value that is different from a set value to activate the overcurrent protection circuit U. For example, if the limit of the primary current I1 is set to shut down the low-voltage power supply circuit 100 when the output current Io is X (A), the overcurrent protection circuit U may be activated to shut down the low-voltage power supply circuit even if the value of the primary current I1 is smaller than X (A) by a variation $\alpha$.

In the printer 1 according to this illustrative aspect, the control device 80 is configured to regulate the current to be supplied to the high-voltage generation circuit 150 after the activation of the motors 93, 97. That is, the control device 80 executes a peak control process to limit the peak of the output current of the low-voltage power supply circuit 100. More specifically described, the control device 80 is configured to activate the high-voltage generation circuit 150 later than the motors 93, 97 so that the starting current starts flowing through the high-voltage generation circuit 150 later than through the motors 93, 97. The starting current of each motor 93, 97 is a motor current that is supplied by the low-voltage power supply circuit 100 to each motor 93, 97 at the activation of the motors 93, 97. The starting current of the high-voltage generation circuit 150 is a current that is supplied by the low-voltage power supply circuit 100 to the high-voltage generation circuit 150 at the activation of the high-voltage generation circuit 150.

In the first illustrative aspect, the peak control process is executed only if a condition that shows an indication of an increase in the output current $I_o$ from the low-voltage power supply circuit 100 is satisfied. This is because a malfunction of the overcurrent protection circuit U is likely to occur if an increase in the output current $I_o$ is present.

For example, the output current Io from the low-voltage power supply circuit 100 is likely to increase when the temperature measured by the temperature sensor 65 (the temperature in the printer 1) is lower than a predetermined temperature (for example, 10° C.) and the number of printed sheets 15 counted by the print counter 67 exceeds a predetermined number (for example, 40,000). In the first illustrative aspect, if the above two conditions are satisfied, the peak control process is executed.

The output current Io is likely to increase when the temperature measured by the temperature sensor 65 is lower than the predetermined temperature, because a larger amount of the motor current is required at a low temperature to increase a torque to a predetermined torque according to characteristics of the motor. Further, the output current Io is likely to increase when the number of printed sheet 15 counted by the print counter 67 exceeds the predetermined number, because the load on the motor increases as the mechanical loss increases.

6. Execution Sequence of the Peak Control Process

Figure 6:
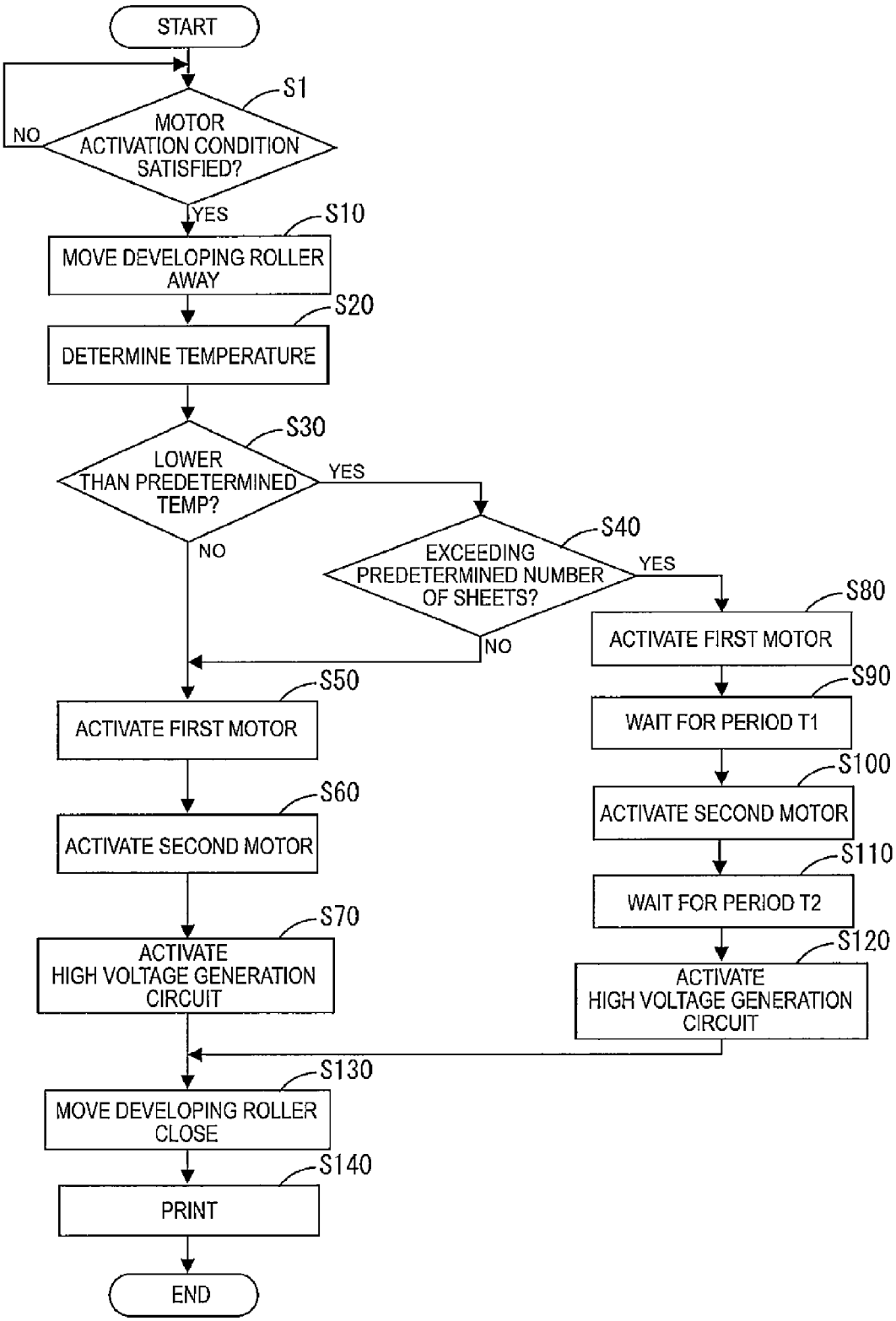
FIG. 6 is a flow chart illustrating an execution sequence of a peak control process.

Next, the execution sequence of the peak control process executed by the control device 80 will be explained with reference to FIG. 6. The control device 80 executes the execution sequence of the peak control process indicated in FIG. 6 upon receiving the print job from the information terminal device.

Upon receiving the print job, the control device 80 determines if a motor activation condition to activate the motors 93, 97 is satisfied. The motor activation condition is satisfied when the control device 80 receives a motor activation signal. If the motor activation condition is not satisfied, the process returns to the start. If the motor activation condition is satisfied, the control device 80 causes the displacement unit 70 to move the development rollers 45 for each color away from the corresponding photosensitive drums 41 (S10). Then, the control device 80 receives the detected value from the temperature sensor 65 and determines the temperature measured by the temperature sensor 65 (S20). Subsequently, the control device 80 determines whether the temperature measured by the temperature sensor 65 is lower than a predetermined temperature (for example, 10° C.) (S30).

If the temperature measured by the temperature sensor 65 is equal to or higher than the predetermined temperature (S30: NO), the control device 80 activates the first motor 93 (S50). Specifically, the control device 80 inputs the control signal 51 to the first motor driving circuit 91 to activate the first motor 93. Upon receiving the control signal 51, the first motor driving circuit 91 enables supply of current to the first motor 93. Thus, the starting current starts flowing through the first motor 93 and the first motor starts rotating.

The control device 80 activates the second motor 97 (S60). Specifically, the control device 80 inputs the control signal S2 to the second motor driving circuit 95 to activate the second motor 97. Upon receiving the control signal S2, the second motor driving circuit 95 enables supply of current to the second motor 97. Thus, the staring current starts flowing through the second motor 97 and the second motor 97 starts rotating.

The control device 80 activates the high-voltage generation circuit 150 (S70). Specifically, the control device 80 inputs the PWM signal S3 to the high-voltage generation circuit 150 to activate the high-voltage generation circuit 150. The control device 80 inputs the PWM signal S3 at a PWM value corresponding to a first voltage that is the set voltage for the image formation (for example, 6.3 kV). Accordingly, at the activation, the set voltage of the high-voltage generation circuit 150 is equal to the first voltage (for example, 6.3 kV).

The control device 80 activates the first motor 93 (S50), the second motor 97 (S60), and the high-voltage generation circuit 150 (S70) without time delay. Specifically, the control device 80 inputs the control signal 51 to the first motor driving circuit 91, inputs the control signal S2 to the second motor driving circuit 95 immediately after the input of the control signal 51, and inputs the PWM signal S3 to the high-voltage generation circuit 150 immediately after the input of the control signal S2. Accordingly, the starting current starts to be supplied to each of the first motor 93, the second motor 97, and the high-voltage generation circuit 150 without time interval. Thus, the output current Io in the low-voltage power supply circuit 100 becomes relatively high.

When the high-voltage generation circuit 150 activates simultaneously with the first motor 93 and the second motor 97, the rotation of the photosensitive drums 41B, 41Y, 41M, 41C by the activation of the motors 93, 97 and the discharge of the chargers 50B, 50Y, 50M, 50C start at the same time. That is, the photosensitive drums 41B, 41Y, 41M, 41C are charged immediately after the rotation started.

When the entire circumferences of the photosensitive drums 41B, 41Y, 41M, 41C are charged after being rotated by 360 degrees, for example, the control device 80 activates the displacement unit 70 to move the development rollers 45 for each color that are located away from the photosensitive drums 41B, 41Y, 41M, 41C to be in close contact with the photosensitive drums 41B, 41Y, 41M, 41C (S130). Then, the control device 80 executes a printing process to print the print data of the received print job on the sheet 15 (S140). When the printing process is completed, the printing sequence is terminated.

If the temperature measured by the temperature sensor 65 is lower than the predetermined temperature (S30: YES), the control device 80 further determines whether the number of sheets 15 counted by the print counter 67 exceeds the predetermined number (for example, 40,000) (S40). If the number of printed sheets is equal to or smaller than the predetermined number (S40: NO), the process proceeds to step S50.

Step S50 is the same step as the step that is executed by the control device 80 when the temperature measured by the temperature sensor 65 is lower than the predetermined temperature (S30: NO). Accordingly, like the above, the first motor 93, the second motor 97, and the high-voltage generation circuit 150 activate (S50, S60, and S70) without time interval.

As a result, the rotation of the photosensitive drums 41B, 41Y, 41M, 41C by the activation of the first and second motors 93, 97 and the discharge of the chargers 50B, 50Y, 50M, 50C start at substantially the same time. Accordingly, the photosensitive drums 41B, 41Y, 41M, 41C are charged immediately after the rotation started.

When the entire circumferences of the photosensitive drums 41B, 41Y, 41M, 41C are charged after being rotated by 360 degrees, for example, the control device 80 activates the displacement unit 70 to move the development roller 45 for each color to be in close contact with each photosensitive drum 41B, 41Y, 41M, 41C (S130). Then, the control device 80 executes a printing process to print the print data of the received print job on the sheet 15 (S140). When the printing process is completed, the printing sequence is terminated.

Next, if the temperature measured by the temperature sensor 67 is lower than the predetermined temperature (S30: YES) and the number of printed sheets 15 exceeds the predetermined number (S40: YES), the peak control process is performed. The peak control process according to the first illustrative aspect includes steps S80, S90, S100, S110, and S120.

In the peak control process, the control device 80 activates the first motor 93 (S80). Specifically, the control device 80 inputs the control signal Si to the first motor driving circuit 91 to activate the first motor 93. Upon receiving the control signal S1, the first motor driving circuit 91 enables supply of current to the first motor 93. Thus, the starting current starts flowing through the first motor 93 and the first motor 93 starts rotating. By the rotation of the first motor 93, the photosensitive drum 41B for black starts rotating. After the activation of the first motor 93, the control device 80 executes a waiting process to wait for a period T1 (for example, 300 ms) (S90). The period T1 is measured by the timer 87 of the control device 80.

After the period T1, the control device 80 activates the second motor 97 (S100). Specifically, the control device 80 inputs the control signal S2 to the second motor driving circuit 95 to activate the second motor 97 (S100). Upon receiving the control signal S2, the second motor driving circuit 95 enables supply of current to the second motor 97. Accordingly, as indicated in FIG. 7, the starting current starts flowing through the second motor 97 and the second motor 97 starts rotating at the second motor activation timing t2 at which the period T1 has elapsed since the first motor activation timing 1.

By the rotation of the second motor 97, the photosensitive drums 41Y, 41M, 41C for yellow, magenta, and cyan are started to rotate. After the activation of the second motor 97, the control device 80 executes a waiting process to wait for a period T2 (for example, 50 ms) (S110). The period T2 is measured by the timer 87 of the control device 80.

When the period T2 has elapsed since the activation of the second motor 97, the control device 80 activates the high-voltage generation circuit 150 (S120). Specifically, the control device 80 inputs the PWM signal S3 to the high-voltage generation circuit 150 to activate the high-voltage generation circuit 150. At this time, the control device 80 inputs the PWM signal S3 at the PWM value corresponding to the first voltage (for example, 6.3 kV) that is the set voltage for the image formation. Accordingly, at the time of activation of the high-voltage generation circuit 150, the set voltage for the high-voltage generation circuit 150 is equal to the first voltage (for example, 6.3 kV).

Figure 7:
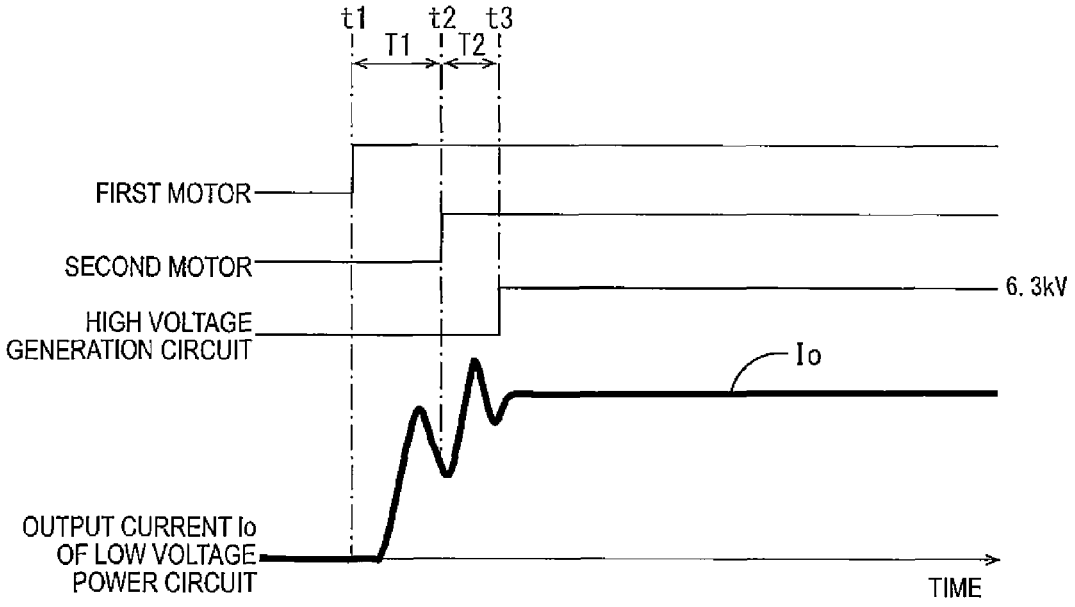
FIG. 7 is a timing chart illustrating first motor activation timing, second motor activation timing, and high-voltage generation circuit activation timing

As illustrated in FIG. 7, at the high-voltage generation circuit activation timing t3 at which the period T2 has elapsed since the second motor activation timing t2, the high-voltage generation circuit 150 activates and the starting current starts flowing through the high-voltage generation circuit 150. Then, by the activation of the high-voltage generation circuit 150, the chargers 50B, 50Y, 50M, 50C start to discharge. Thus, at the high-voltage generation circuit activation timing t3, the photosensitive drum 41B that starts to rotate at the first motor activation timing t1 and the photosensitive drums 41Y, 41M, 41C that start to rotate at the second motor activation timing t2 start to be charged.

As described above, if the temperature in the printer 1 is lower than the predetermined temperature and the number of printed sheets counted by the print counter 67 exceeds the predetermined number (for example, 40,000), the first motor 93, the second motor 97, and the high-voltage generation circuit 150 activate at different times.

Then, when the entire circumference of each photosensitive drum 41B, 41Y, 41M, 41C is charged, the control device 80 activates the displacement unit 70 to move the development rollers 45 for each color to be in close contact with the photosensitive drums 41B, 41Y, 41M, 41C (S130). Subsequently, the control device 80 executes a printing process to pint the print data of the received print job on the sheet 15 (S140). When the printing process is completed, the printing sequence is terminated.

7. Advantages

In the peak control process of the printer 1, the control device 80 activates the high-voltage generation circuit 150 later than the motors 93, 97. That is, the staring current is to be supplied to the high-voltage generation circuit 150 later than to the motors 93, 97. With this configuration, compared to the case where the starting current start to be supplied to the high-voltage generation circuit 150 and the motors 93, 97 without time interval, the peak of the output current Io of the low-voltage power supply circuit 100 can be limited. Accordingly, the malfunction of the overcurrent protection circuit U due to the variations in the current is less likely to occur.

In the printer 1, the set voltage for activation of the high-voltage generation circuit 150 is equal to the first voltage that is the set voltage for image formation. With this configuration, the set voltage of the high-voltage generation circuit 150 does not need to be changed after its activation, and thus the control device 80 can control the high-voltage generation circuit 150 in a simple way.

In the printer 1, the peak control process to limit the peak of the output current Io of the low-voltage power supply circuit 100 is executed only when the temperature in the printer 1 is lower than the predetermined temperature and the number of printed sheets counted by the printer counter 67 exceeds the predetermined number. With this configuration, the peak control process can be executed less frequently.

Further, in the printer 1, during the charging of the photosensitive drums 41 by the chargers 50, the photosensitive drums 41 are located away from the development rollers 45. With this configuration, the toner, which is supplied through the development rollers 45, is hardly attached to the photosensitive drums 41 during the charging. Accordingly, the quality of the printed image can be maintained at a high level.

<Second Illustrative Aspect>

Figure 8:
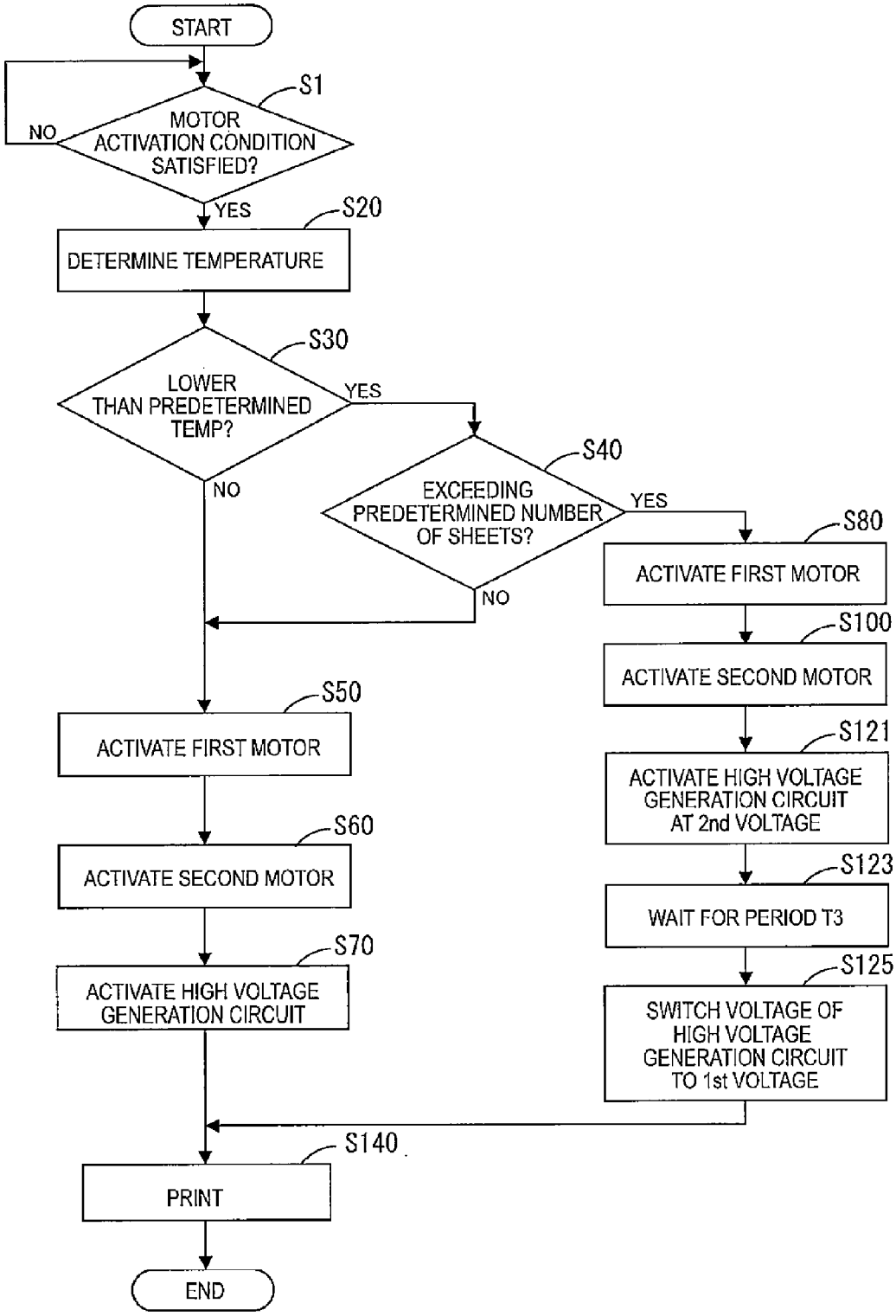
FIG. 8 is a flow chart illustrating an execution sequence of a peak control process according to an illustrative aspect.
Figure 9:
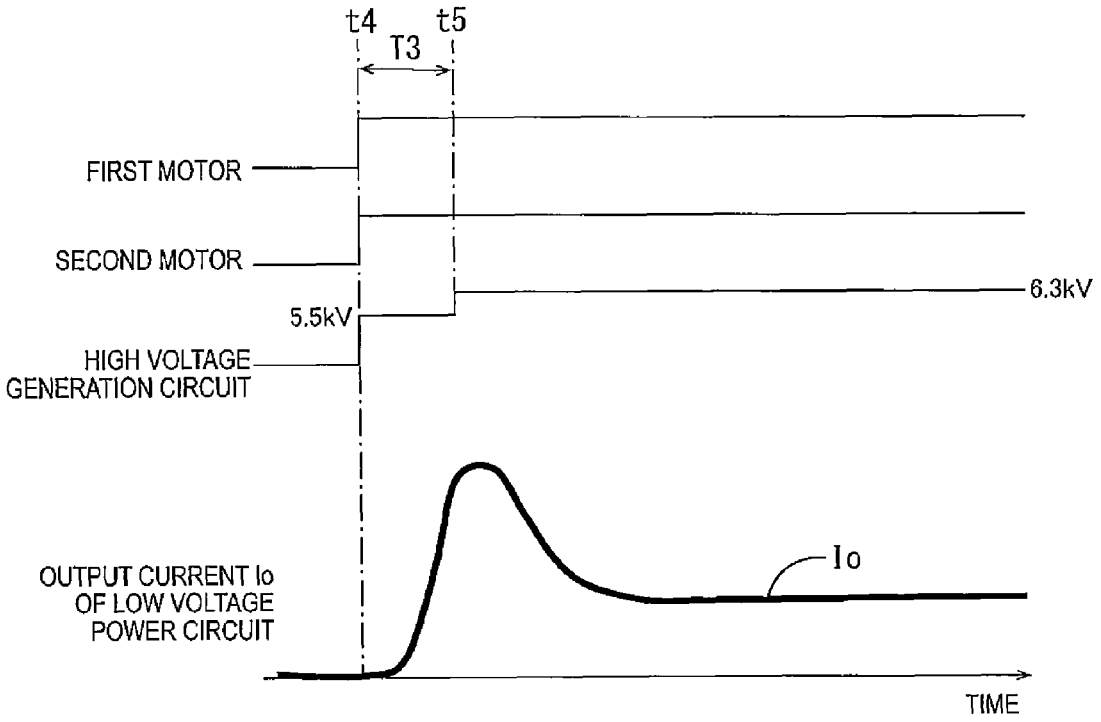
FIG. 9 is a timing chart illustrating first motor activation timing, second motor activation timing, and high-voltage generation circuit activation timing

The second illustrative aspect of the present invention will be explained with reference to FIG. 8 to FIG. 10.

In the peak control process according to the first illustrative aspect, the control device 80 activates the high-voltage generation circuit 150 later than the motors 93, 97 so that the supply of the starting current to the high-voltage generation circuit 150 starts later than the start of the starting current supply to the motor 93, 97.

In the second illustrative aspect, the way of limiting the peak is different from that of the first illustrative aspect. Specifically, the voltage of the high-voltage generation circuit 150 is set to be a second voltage (for example, about 5.5 kV) that is lower than the first voltage (for example, about 6.3 kV) for the image formation. The lower the set voltage of the high-voltage generation circuit 150, the lower the starting current of the high-voltage generation circuit 150. Thus, if the set voltage of the high-voltage generation circuit 150 is lowered, the amount of the starting current of the high-voltage generation circuit 150 that is supplied at the same time with the starting current of the motor 93, 97 is reduced. Accordingly, like the first illustrative aspect, the peak of the output current Io of the low-voltage power supply circuit 100 can be limited.

Hereinafter, the execution sequence of the peak control process according to the second illustrative aspect will be explained with reference to FIG. 8. Like the first illustrative aspect, in the peak control process of the second illustrative aspect, the control device 80 determines whether the temperature measured by the temperature sensor 65 is lower than the predetermined temperature (S30) and whether the number of printed sheets counted by the print counter 67 exceeds the predetermined number (S40). The peak control process is executed if the temperature measured by the temperature sensor 65 is lower than the predetermined temperature and the number of printed sheets counted by the print counter 67 exceeds the predetermined number (for example, 40,000), i.e., YES in both S30 and S40.

The peak control process according to the second illustrative aspect includes S80, S100, S121, S123, and S125. The control device 80 activates the first motor 93 (S80). The control device 80 inputs the control signal 51 to the first motor driving circuit 91 to activate the first motor 93. Upon receiving the control signal 51, the first motor driving circuit 91 enables supply of the current to the first motor 93. Thus, the starting current starts flowing through the first motor 93 and the first motor 93 start rotating.

The control device 80 activates the second motor (S100). The control device 80 inputs the control signal S2 to the second motor driving circuit 95 to activate the second motor 97. Upon receiving the control signal S2, the second motor driving circuit 91 enables supply of current to the second motor 97. Thus, the starting current starts flowing through the second motor 97 and the second motor 97 start rotating.

The control device 80 activates the high-voltage generation circuit 150 (S121). The control device 80 inputs the PWM signal S3 to the high-voltage generation circuit 150 to activate the high-voltage generation circuit 150.

The control device 80 activates the first motor 93 (S80), the second motor 97 (S100), and the high-voltage generation circuit 150 (S121) without time delay. Specifically, the control device 80 inputs the control signal 51 to the first motor driving circuit 91, inputs the control signal S2 to the second motor driving circuit 95 immediately after the input of the control signal 51, and inputs the PWM signal S3 to the high-voltage generation circuit 150 immediately after the input of the control signal S2. Accordingly, the first motor 93, the second motor 97, and the high-voltage generation circuit 150 activate without time interval.

In step S121, the control device 80 inputs the PWM signal S3 to the high-voltage generation circuit 150 at the PWM value corresponding to the second voltage that is lower than the first voltage, which is the set voltage for the image formation. Thus, by the control device 80, the set voltage for the activation of the high-voltage generation circuit 150 is controlled to be the second voltage that is lower than the first voltage. Accordingly, the amount of the starting current of the high-voltage generation circuit 150 that is supplied at the same time with the starting current of the motors 93, 97 is reduced, and thus the peak of the output voltage To of the low-voltage power supply circuit 100 is limited like the first illustrative aspect.

The second voltage may be larger than a discharge starting voltage at which the discharge from the wire 53 of the charger 50 starts (for example, 5 kV). With this configuration, the charging of the photosensitive drums 41 can be started immediately after the rotation thereof started, and thus the toner in the air is hardly attached to the rotating photosensitive drums 41.

After the activation of the high-voltage generation circuit 150, the control device 80 executes a waiting process to wait for a period T3 (S123). When the period T3 has elapsed since the activation of the high-voltage generation circuit 150, the control device 80 switches the set voltage of the high-voltage generation circuit 150 from the second voltage to the first voltage by changing the PWM value of the PWM signal S3 (S125). As indicated in FIG. 9, the set voltage of the high-voltage generation circuit 150 is switched to the first voltage (for example, 6.3 kV) at switch timing t5 at which the period T3 has elapsed since an activation timing t4. The activation timing t4 is timing to activate the high-voltage generation circuit 150. The period T3 is measured by the timer 87 of the control device 80.

Figure 10:
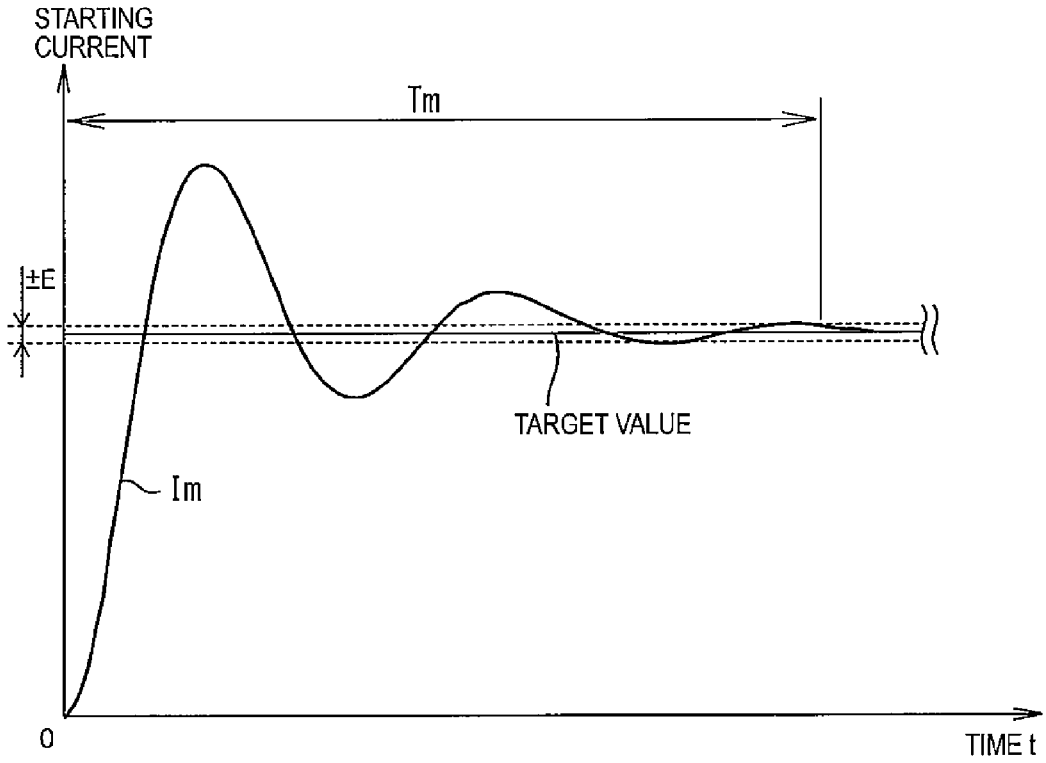
FIG. 10 is a view illustrating a waveform of a motor current.

The period T3 is set to be longer than a stabilization time Tm for stabilizatng the starting current Im of each motor 93, 97 (see FIG. 10). Specifically, if the first motor 93 and the second motor 97 take different stabilization times to stabilize the starting current, the period T3 is set based on longer one of the stabilization times. The longer one of the stabilization times is 300 ms, for example. In such a case, the period T3 is set at 300 ms that is the longer one of the stabilization times Tm.

Since the period T3 is set to be longer than the stabilization time Tm, the set voltage of the high-voltage generation circuit 150 is switched from the second voltage to the first voltage after the stabilization of the starting current Im of each motor 93, 97. By setting the period T3 as above, a large peak is less likely to be present compared to the case where the set voltage is switched before the stabilization of the starting current Im of each motor 93, 97. The amount of the output current Io of the low-voltage power supply circuit 100 is reduced.

The stabilization of the starting current Im of each motor 93, 97 means "a response is in a predetermined acceptable range E, for example, in a range of 5% above and below the target value". Further, "the stabilization time Tm" is duration of time required to stabilize the starting current Im from a start of supply of the starting current Im (see FIG. 10). The stabilization time Tm of the starting current Im can be calculated from a circuit constant of each motor 93, 97 or each motor driving circuit 91, 95. In the second illustrative aspect, the stabilization time Tm is calculated using the circuit constant. Other than the above, the stabilization time Tm of the starting current Im may be obtained using an actual measured value obtained by a test circuit.

After switching the set voltage from the second voltage to the first voltage, the control device 80 executes the printing process to print the print data of the received print job on the sheet 15 (S140). When the printing process is completed, the printing sequence is terminated.

In the peak control process according to the second illustrative aspect, when the motor activation condition to activate the motors 93, 97 is satisfied, the set voltage of the high-voltage generation circuit 150 is equal to be the second voltage that is lower than the first voltage for the image formation. The lower the set voltage of the high-voltage generation circuit 150, the lower the starting current of the high-voltage generation circuit 150. Thus, the amount of the staring current of the high-voltage generation circuit 150 that is supplied at the same time with the starting current of the motors 93, 97 is reduced. Accordingly, like the first illustrative aspect, the peak of the output voltage To of the low-voltage power supply circuit 100 is limited.

In the peak control process according to the second illustrative aspect (S80, S100, S121, S123, S125), the control device 80 activates the motors 93, 97 and the high-voltage generation circuit 150 without time delay. With this configuration, the charging of the photosensitive drums 41 starts immediately after the photosensitive drums 41 starts rotating, and thus the toner in the air is hardly attached to the photosensitive drums 41.

<Other Illustrative Aspects>

The present invention is not limited to the illustrative aspects described above with reference to the drawings, and may include the following various illustrative aspects in the technical scope of the invention.

(1) In the above first and second illustrative aspects, the control device 80 includes one CPU 81, the ROM 83, the NVRAM 85, and the like. However, the number of CPUs 81 may be two or more. Further, the control device 80 may include the CPU 81 and a hard circuit such as an ASIC or may only include a hard circuit.

(2) In the above first and second illustrative aspects, the printer 1 includes the first motor 93 and the second motor 97. However, the printer 1 may include only one motor or more than two motors.

(3) In the above first and second illustrative aspect, the peak control process is executed if the temperature measured by the temperature sensor 65 is lower than the predetermined temperature and the number of printed sheets 15 counted by the print counter 67 exceeds the predetermined number. However, the peak control process may be executed when one of the above conditions that shows an indication of increase in the output current Io from the low-voltage power supply circuit 100, is satisfied. Namely, the peak control process may be executed if the temperature measured by the temperature sensor 65 is lower than the predetermined temperature or if the number of printed sheets 15 counted by the print counter exceeds the predetermined number.

(4) In the peak control process according to the first illustrative aspect, the motors 93, 97 and the high voltage generation circuit 100 may activate in any order as long as there is the time interval between the activations.

(5) In the peak control process according to the above second illustrative aspect, the motors 93, 97 and the high-voltage generation circuit 150 activate without time delay. However, the high-voltage generation circuit 150 may activate before the activation of the motors 93, 97 as long as the set voltage of the high-voltage generation circuit 150 is equal to the second voltage that is lower than the first voltage for the image formation.

In a known power supply circuit including an overcurrent protection circuit at a primary side thereof, a series of steps from the detection of an overcurrent to the shutdown of the circuit can be completed at the primary side. This can reduce the number of components of the power supply circuit compared to a power supply circuit including an overcurrent protection circuit at a secondary side thereof. Accordingly, the power supply circuit including the overcurrent protection circuit at the primary side can include a smaller substrate, for example. However, malfunction may occur in the overcurrent protection circuit of such a known power supply circuit due to variations in a secondary current with respect to a primary current. Thus, a peak of an output current of the power supply circuit may be required to be limited. According to the technology described in the above illustrative aspects, the peak of the output current is limited and thus an improper operation of the overcurrent protection circuit is less likely to occur.

What is claimed is:

1. An image forming apparatus comprising:

a power supply circuit;

at least one motor configured to receive electric power from the power supply circuit;

a photosensitive body configured to be rotated by the motor for forming an image on a sheet;

a charger configured to charge the photosensitive body;

a high voltage generation circuit configured to receive electric power from the power supply circuit and generate a high voltage applied to the charger; and a control device configured to:

determine whether a motor activation condition to activate the motor is satisfied;

determine whether a limitation condition to limit a peak of a current output from the power supply circuit is satisfied; and regulate the current flowing through the high-voltage generation circuit if the motor activation condition and the limitation condition are satisfied, whereby the peak of the current output from the power supply circuit is limited.

2. The image forming apparatus according to claim 1, wherein the control device is further configured to activate the high-voltage generation circuit later than the motor.

3. The image forming apparatus according to claim 2, wherein the control device is further configured to set a voltage required to activate the high-voltage generation circuit equal to a voltage defined for image formation.

4. The image forming apparatus according to claim 1, wherein the control device is further configured to:

activate the high-voltage generation circuit simultaneously with the motor, and set a voltage required to activate the high-voltage generation circuit equal to a second voltage, the second voltage being lower than a first voltage defined for image formation.

5. The image forming apparatus according to claim 4, wherein the charger is a scorotron charger, and the second voltage is larger than a voltage at which the scorotron charger starts discharging.

6. The image forming apparatus according to claim 4, wherein the control device is further configured to switch the voltage of the high-voltage generation circuit from the second voltage to the first voltage after the starting current applied to the motor stabilizes.

7. The image forming apparatus according to claim 1, further comprising:

a developing unit configured to develop an electrostatic latent image on the photosensitive body using a developer, the photosensitive body being charged by the charger; and a displacement unit configured to move the developing unit between a position away from the photosensitive body and a position in which the developing unit is in close contact with the photosensitive body, wherein the control device is further configured to cause the displacement unit to move the developing unit away from the photosensitive body, and to fix the developing unit in the position away from the photosensitive body during charging of the photosensitive body by the charger.

8. The image forming apparatus according to claim 1, further comprising:

a sensor configured to detect a temperature in the image forming apparatus; and a counter configured to count a number of printed sheets, wherein the control device is further configured to:

determine whether the temperature detected by the sensor is lower than a predetermined temperature;

determine whether the number of printed sheets exceeds a predetermined number; and determine that the limitation condition to limit the peak of the output current from the power supply circuit is satisfied if the temperature is lower than the predetermined temperature and the number of printed sheets exceeds the predetermined number.

9. The image forming apparatus according to claim 1, wherein the power supply circuit is a switching power supply circuit including an insulation transformer, the power supply circuit includes a current detecting element at a primary side of the switching power supply circuit, and the current detecting element configures an overcurrent protection circuit, the overcurrent protection circuit being configured to shut down the power supply circuit to protect the power supply circuit from overcurrent.

10. The image forming apparatus according to claim 1, further comprising a sensor configured to detect a temperature in the image forming apparatus, wherein the control device is further configured to:

determine whether the temperature detected by the sensor is lower than a predetermined temperature; and determine that the condition to limit the peak of the output current of the power supply circuit is satisfied if the temperature is lower than the predetermined temperature.

11. The image forming apparatus according to claim 1, further comprising a counter configured to count a number of printed sheets, wherein the control device is further configured to:

determine whether the number of printed sheets exceeds a predetermined number; and determine that the condition to limit the peak of the output current of the power supply circuit is satisfied if the number of printed sheets exceeds the predetermined number.

12. The image forming apparatus according to claim 1, further includes a motor driving circuit, wherein the control device is further configured to:

input a first control signal to the motor driving circuit so that the motor activates; and input a second control signal to the high-voltage generation circuit so that the high-voltage generation circuit activates.

13. The image forming apparatus according to claim 2, wherein the at least one motor includes a first motor and a second motor, the control device includes a timer, and the control device is further configured to:

sequentially activate the first motor, the second motor, and the high-voltage generation circuit;

measure a first period and a second period with the timer;

wait for the first period to activate the second motor after the activation of the first motor; and wait for the second period to activate the high-voltage generation circuit after the activation of the second motor.

14. The image forming apparatus according to claim 6, wherein the control device includes a timer configured to measure a stabilization time for stabilizing the starting current applied to the motor, and the control device is further configured to wait for the stabilization time before switching the set voltage of the high-voltage generation circuit from the second voltage to the first voltage.

15. The image forming apparatus according to claim 9, wherein the power supply circuit further includes a control IC at the primary side of the switching power supply circuit, wherein the current detecting element and the control IC configure the overcurrent protection circuit.

* * * * *